US009165484B2

(12) United States Patent
Choi

(10) Patent No.: US 9,165,484 B2
(45) Date of Patent: Oct. 20, 2015

(54) MULTI-SYMBOL INDICATION APPARATUS

(75) Inventor: Sung Sik Choi, Hwaseong-si (KR)

(73) Assignees: HYUNDAI MOTOR COMPANY, Seoul (KR); KIA MOTORS CORP., Seoul (KR)

( * ) Notice: Subject to any disclaimer, the term of this patent is extended or adjusted under 35 U.S.C. 154(b) by 680 days.

(21) Appl. No.: 13/487,735

(22) Filed: Jun. 4, 2012

(65) Prior Publication Data

US 2013/0147401 A1 Jun. 13, 2013

(30) Foreign Application Priority Data

Dec. 9, 2011 (KR) ..... 10-2011-0131842

(51) Int. Cl.
*G09F 13/04* (2006.01)
*G09F 13/12* (2006.01)
*G09F 13/14* (2006.01)

(52) U.S. Cl.
CPC ..... *G09F 13/04* (2013.01); *G09F 13/12* (2013.01); *G09F 13/14* (2013.01)

(58) Field of Classification Search
CPC ..... G09F 13/02; G09F 13/04; G09F 13/06; G09F 13/08; G09F 13/12; G09F 13/14; G09F 13/18; G09F 13/20; G09F 13/22; G09F 13/42; B60Q 1/1476; B60Q 1/2603; B60Q 1/2607; B60Q 1/50; B60Q 3/004; B60Q 3/008; B60Q 3/042; B60Q 3/044; B60Q 3/048; F21V 9/08; F21V 9/10; F21V 9/16
USPC ..... 315/322
See application file for complete search history.

(56) References Cited

U.S. PATENT DOCUMENTS 7,658,519 B2 * 2/2010 Mita et al. ..... 362/482
2014/0049983 A1 * 2/2014 Nichol et al. ..... 362/610

FOREIGN PATENT DOCUMENTS

JP 6-40271 A 2/1994

* cited by examiner

*Primary Examiner* — Lincoln Donovan
*Assistant Examiner* — David Mattison
(74) *Attorney, Agent, or Firm* — Morgan, Lewis & Bockius LLP

(57) ABSTRACT

A multi-symbol indication apparatus, may include a plurality of light sources, each of the light sources emitting light of a single color, a plurality of filter units, each of the filter units installed above the light sources with different height each other and reflecting light of the single color corresponding to the relevant light source, wherein a symbol may be carved on each of the filter units, and a display cover installed above the filter units.

7 Claims, 3 Drawing Sheets

MULTI-SYMBOL INDICATION APPARATUS

CROSS-REFERENCE TO RELATED APPLICATIONS

The present application claims priority to Korean Patent Application No. 10-2011-0131842 filed on Dec. 9, 2011, the entire contents of which is incorporated herein for purposes by this reference.

BACKGROUND OF THE INVENTION

1. Field of the Invention

The present invention relates to a multi-symbol indication apparatus, which can apply multiple symbols to a limited space by theoretically using a plurality of filters when the operating wavelength ranges of light sources and filters do not overlap each other.

2. Description of Related Art

A multi-symbol indication apparatus refers to an apparatus used when multiple symbols must be selectively indicated in a limited space.

Such an apparatus is mainly used in an indicator or the like of a vehicle, and is configured such that individual symbols emit light of different colors so as to indicate multiple symbols while alternating the symbols at the same location on a single panel.

In the prior art, for this functionality, a multi-symbol indication apparatus is configured such that a plurality of light sources of different colors are provided and a single panel is installed above the light sources, wherein a part of the panel in which symbols appear is processed to be transparent, the respective symbol parts are coated with different colors to perform filtering, and overlapping parts are processed to be transparent, thus enabling the respective symbols to appear in different colors at the same location.

That is, there is a single panel, but the symbols in the panel are coated with different colors for filtering and the overlapping parts are processed to be transparent so that different colors can pass through the respective symbols of the panel.

However, such a multi-symbol indication apparatus is disadvantageous in that the individual symbols are carved and coated, and the overlapping parts are processed to be transparent, thus requiring very delicate and complicated operations.

As a result, a defective rate has increased. Further, the overlapping parts are processed to be transparent and then cause a difference in luminance with the remaining parts, thus causing even a single symbol to appear spotted in spite of being the same color.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a multi-symbol indication apparatus, which can apply multiple symbols to a limited space by theoretically using a plurality of filters when the operating wavelength ranges of light sources and filters do not overlap each other.

In an aspect of the present invention, a multi-symbol indication apparatus, may include a plurality of light sources, each of the light sources emitting light of a single color, a plurality of filter units, each of the filter units installed above the light sources with different height each other and reflecting light of the single color corresponding to the relevant light source, wherein a symbol is carved on each of the filter units, and a display cover installed above the filter units.

The light sources emit light of different colors, respectively.

Each of the filter units reflects light of a single designated color and passes light of remaining colors therethrough.

The symbols of the filter units are holes formed through corresponding filter units in shapes of corresponding symbols.

The filter units are formed such that respective symbols are arranged to overlap one another at an identical location.

The filter units are a dichroic filter.

In another aspect of the present invention, a multi-symbol indication apparatus, may include a plurality of light sources, each of the light sources emitting light of a single color, a plurality of filter units, each installed above the light sources with different height each other and reflecting light of the single color corresponding to the relevant light source, wherein a symbol is carved in each filter unit, a display cover installed above the filter units, and a control unit configured to, when a symbol of any one filter unit on the display cover is required to emit light, cause a light source corresponding to a color reflected from the filter unit to emit light.

The filter units are a dichroic filter.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
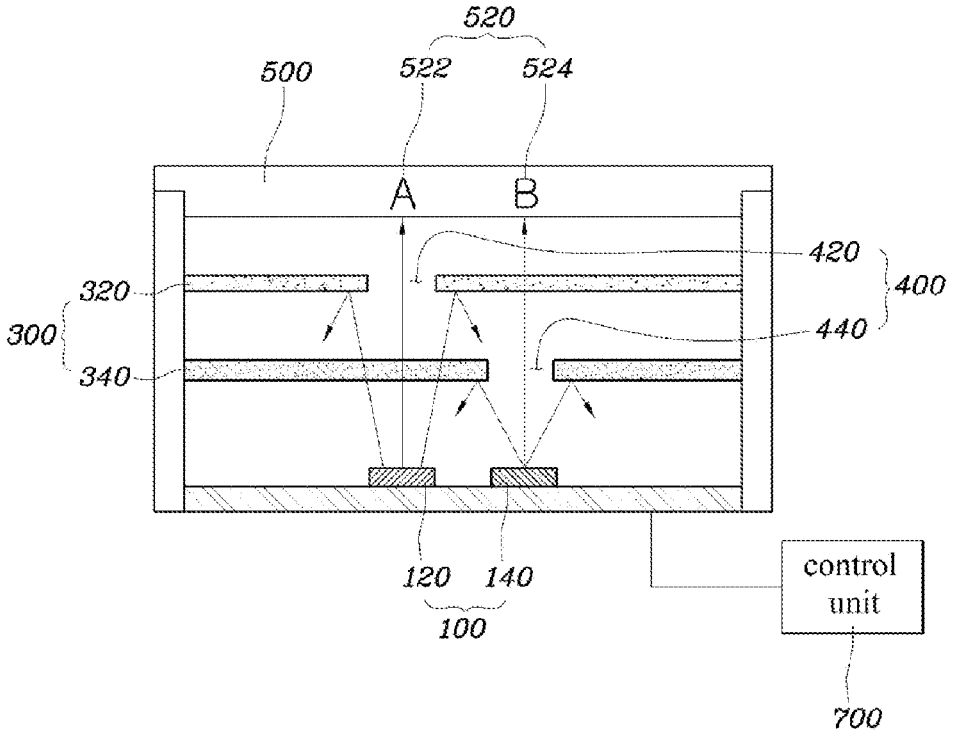
FIG. 1 is a diagram showing the construction of a multi-symbol indication apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, a multi-symbol indication apparatus according to embodiments of the present invention will be described in detail with reference to the attached drawings.

FIG. 1 is a diagram showing the construction of a multi-symbol indication apparatus according to an exemplary embodiment of the present invention. The multi-symbol indication apparatus according to an exemplary embodiment of the present invention includes a plurality of light sources 100, a plurality of filter units 300, and a display cover 500. Each of the light sources 100 is configured to emit only light of a single color. Each of the filter units 300 is installed above the light sources 100 and is configured to reflect only light of a single color corresponding to a relevant light source 100 and to have a symbol 400 formed to be carved therein. The display cover 500 is installed above the filter units 300.

That is, the multi-symbol indication apparatus of the present invention includes the light sources 100 of different colors, the filter units 300 for reflecting only light of colors corresponding to the light sources 100 and passing light of the remaining colors therethrough, and symbols 400 carved in the respective filter units 300. Further, the display cover 500 is installed in the uppermost portion of the multi-symbol indication apparatus, so that the symbols seem to emit light.

For this operation, the respective light sources 100 may emit light of different colors. Further, each of the filter units 300 may be a dichroic filter for reflecting only light of a single designated color and passing light of the remaining colors.

Figure 4:
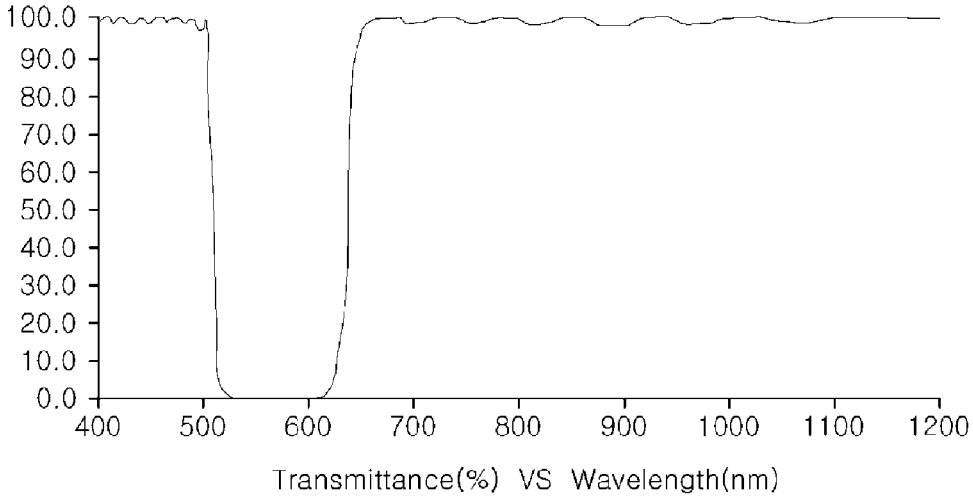
FIG. 4 is a graph showing the dichroic filter of the multi-symbol indication apparatus according to an exemplary embodiment of the present invention.

Here, the term "dichroic filter" refers to a filter for performing the reverse function of a band pass filter that passes only light of a single color therethrough. A graph related to the characteristics of the dichroic filter is shown in FIG. 4.

As shown in the graph, the dichroic filter reflects only light of a designated color and passes all the light of the remaining colors therethrough. Therefore, such a dichroic filter is used, so that when, for example, a green light source 120 emits light, the light passes through the filter unit 340 corresponding to the remaining color, and the symbol 420 carved in the filter unit 320 for filtering light of green is indicated as a character 522.

Further, the symbol 400 of each filter unit 300 may be a hole formed through the filter unit 300 in the shape of the corresponding symbol 400. Since operations for forming symbols are implemented for the respective filter units, they are very easily performed.

Furthermore, the filter units 300 are characterized in that when respective symbols 400 are formed such that they are arranged to overlap one another at the same location, various symbols can alternately appear at the same location even in a narrow space.

Meanwhile, another multi-symbol indication apparatus according to an exemplary embodiment of the present invention includes a plurality of light sources 100, a plurality of filter units 300, a display cover 500, and a control unit 700. Each of the light sources 100 is configured to emit only light of a single color. Each of the filter units 300 is installed above the light sources 100 and is configured to reflect only light of a single color corresponding to a relevant light source 100 and to have a symbol 400 formed to be carved therein. The display cover 500 is installed above the filter units 300. The control unit 700 is configured to, when the symbol 400 of any one filter unit 300 on the display cover 500 must emit light, cause a light source 100 corresponding to a color reflected from the relevant filter unit 300 to emit light. Accordingly, the multi-symbol indication apparatus can alternately indicate various symbols, such as a green symbol or a blue symbol, at the same location under the control of the control unit 700.

Figure 2:
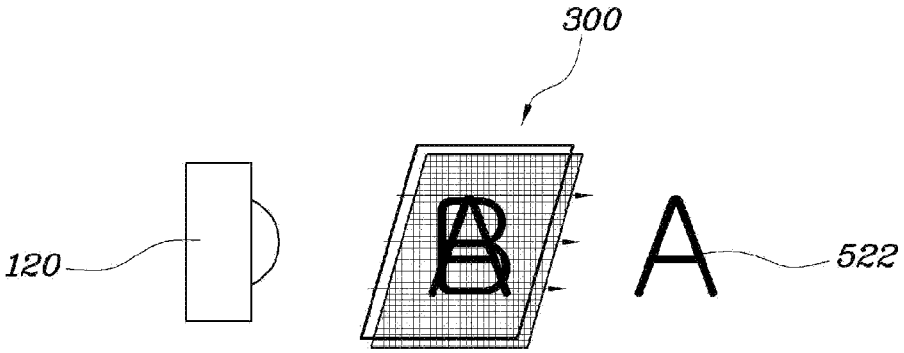
FIGS. 2 and 3 are diagrams showing a procedure in which different symbols appear in the multi-symbol indication apparatus according to an exemplary embodiment of the present invention.
Figure 3:
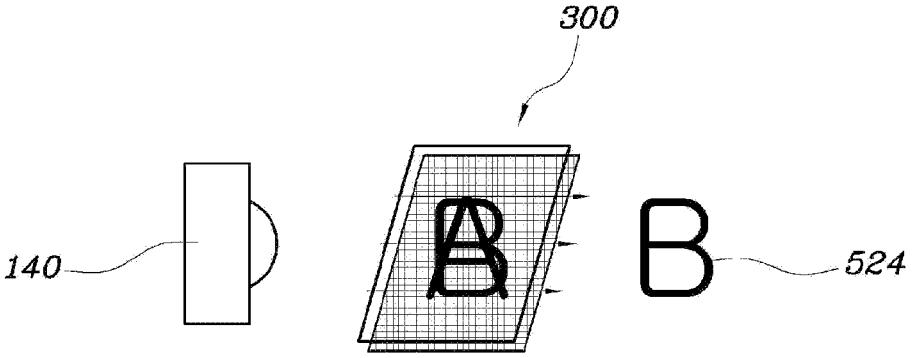

FIGS. 2 and 3 are diagrams showing a procedure in which different symbols appear in the multi-symbol indication apparatus according to an exemplary embodiment of the present invention. In the drawings, even if the locations of two filter units 320 and 340 and symbols 420 and 440 overlap each other, a green light source 120 shown in FIG. 2 indicates green 'A' 522, and a blue light source 140 shown in FIG. 3 indicates blue 'B' 524. The reason for this is that the filter unit 340 fundamentally corresponding to the blue color passes light of the green color therethrough, and thus when the green light source 120 is turned on, the green 'A' 522 may be indicated.

According to the multi-symbol indication apparatus having the above-described construction, multiple symbols may be represented by uniform colors, thus improving visibility and marketability.

Further, since only a single carving operation is required on a corresponding filter so as to implement each color, there is no need to go through a complicated carving and coating procedure.

For convenience in explanation and accurate definition in the appended claims, the terms "upper", and "lower", are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A multi-symbol indication apparatus, comprising:

a plurality of light sources, each of the light sources emitting light of a single color;

a plurality of filter units, each of the filter units installed above the light sources with different height each other and reflecting light of the single color corresponding to the relevant light source, wherein a symbol is carved on each of the filter units; and a display cover installed above the filter units, wherein each symbol of the filter units is a hole formed through corresponding filter units in a shape of a corresponding symbol.

2. The multi-symbol indication apparatus according to claim 1, wherein the light sources emit light of different colors, respectively.

3. The multi-symbol indication apparatus according to claim 1, wherein each of the filter units reflects light of a single designated color and passes light of remaining colors therethrough.

4. The multi-symbol indication apparatus according to claim 1, wherein the filter units are formed such that respective symbols are arranged to overlap one another at an identical location.

5. The multi-symbol indication apparatus according to claim 1, wherein the filter units are a dichroic filter.

6. A multi-symbol indication apparatus, comprising:

a plurality of light sources, each of the light sources emitting light of a single color;

a plurality of filter units, each installed above the light sources with different height each other and reflecting light of the single color corresponding to the relevant light source, wherein a symbol is carved in each filter unit;

a display cover installed above the filter units; and a control unit configured to, when a symbol of any one filter unit on the display cover is required to emit light, cause a light source corresponding to a color reflected from the filter unit to emit light, wherein each symbols of the filter units are a hole formed through corresponding filter units in a shape of a corresponding symbol.

7. The multi-symbol indication apparatus according to claim 6, wherein the filter units are a dichroic filter.

* * * * *